United States Patent [19]

Flug

[11] Patent Number: 4,596,568

[45] Date of Patent: Jun. 24, 1986

[54] DIAPER COVER

[75] Inventor: Rachael Flug, Granada Hills, Calif.

[73] Assignee: Diaperaps Limited, Northridge, Calif.

[21] Appl. No.: 663,704

[22] Filed: Oct. 22, 1984

[51] Int. Cl.[4] ..... A61F 13/16

[52] U.S. Cl. ..... 604/369; 604/378

[58] Field of Search ..... 604/394, 396, 385, 378, 604/369, 358, 393, 389, 391, 397–400

[56] References Cited

U.S. PATENT DOCUMENTS

| | | | |
|---|---|---|---|
| 2,450,059 | 9/1948 | Rickerson | 604/397 |
| 2,468,445 | 4/1949 | Hurst | 604/397 |
| 3,025,856 | 3/1962 | Burwell et al. | 604/398 |
| 3,150,664 | 9/1964 | Noel | 604/391 |
| 3,156,242 | 11/1964 | Crowe, Jr. | 604/369 |
| 3,461,872 | 8/1969 | McConnell et al. | 604/397 |
| 3,881,489 | 5/1975 | Hartwell | 604/369 |
| 3,888,248 | 6/1975 | Moore et al. | 604/369 |
| 4,282,874 | 8/1981 | Mesek | 604/389 |

*Primary Examiner*—John D. Yasko

*Attorney, Agent, or Firm*—Thomas I. Rozsa

[57] ABSTRACT

The present invention is a novel diaper cover which contains a multiplicity of different layers of specific material to provide the essential functions of being essentially nonpermeable to liquid but permeable to air. The diaper cover also provides means to hold and close the diaper without extra diaper closing means.

17 Claims, 3 Drawing Figures

Fig. 1.
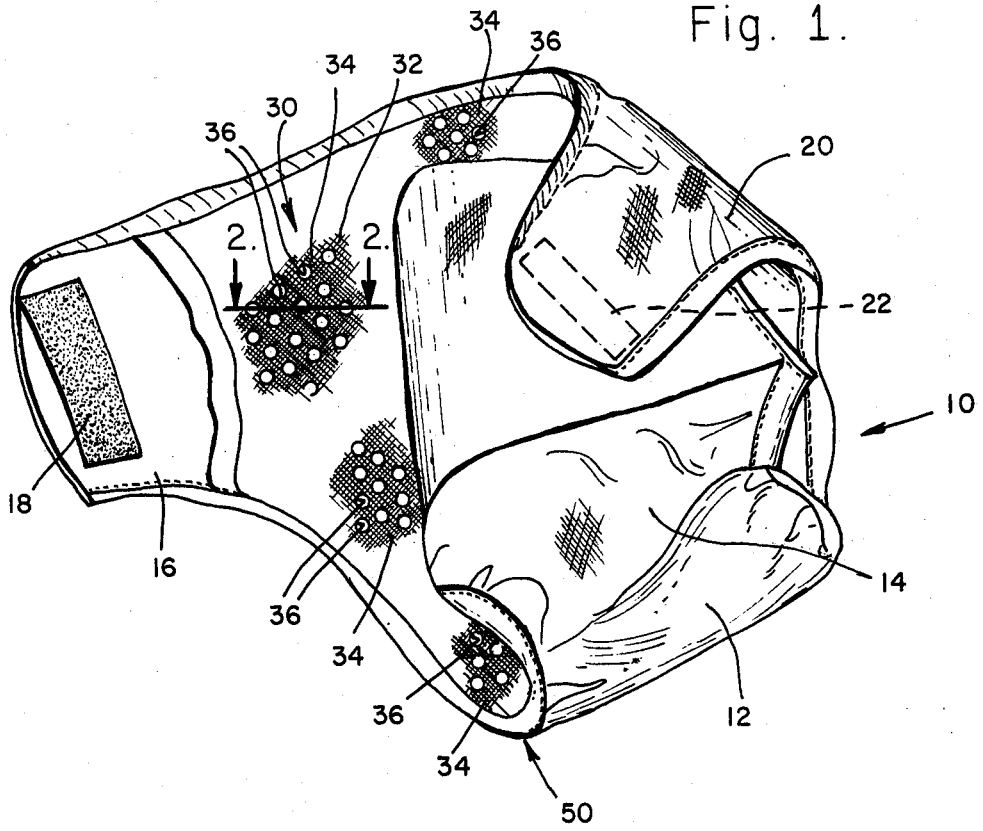
Fig. 2.
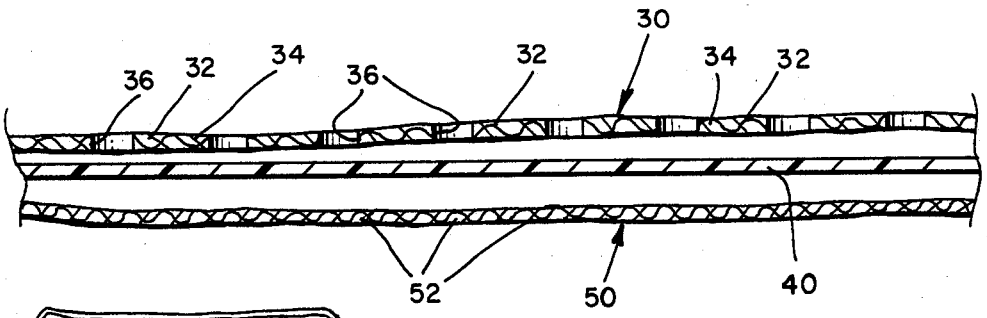
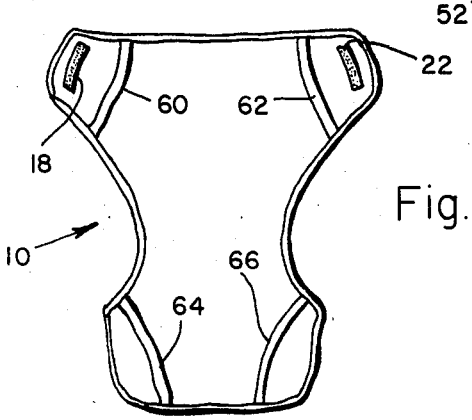
Fig. 3.

DIAPER COVER

BACKGROUND OF THE INVENTION

1. Field of the Invention

The present invention relates to a novel cover which is worn around the outside of diapers by babies. After a diaper is placed on a baby, a diaper cover is used to provide further protection for the infant and to assist in preventing urine and other excrement from seeping out. The diaper cover also assists in reducing the unpleasant smell associated with the baby's urine and excrement.

2. Description of the Prior Art

Numerous types of diaper covers are well known in the prior art. The most basic type of diaper cover consists of a piece of cloth or other comparable material which is wrapped around the diaper and held in place by safety pins or comparable locking devices. While this type of basic diaper cover serves to provide added protection for the infant, it lends very little to effectively preventing urine and other excrement from seeping out and further does not serve to reduce the unpleasant smell associated therewith.

An improvement on this concept involved the use of unitary plastic diaper covers which were slipped over the diaper. Such diaper covers lend very little to absorbant the urine and therefore rashes will occur on the baby's legs and buttocks unless the diaper cover and diaper are frequently changed. Since such plastic diaper covers are not permeable to air, the smell of the urine and other exrement is locked in and therefore creates a very unpleasant odor around the baby.

Other modifications which employ both the cloth and the plastic cover concept are known in the prior art, but they all contain the same disadvantages. They are either permeable to water and therefore permit seepage of exrement or alternatively are nonpermeable to water and air, thereby resulting in a foul smell around the baby and the increased likelihood of causing baby's rash and other skin problems due to the effect of the locked in urine and other exrement against the baby's tender skin. In addition, prior art diaper covers which are made of one piece construction serve to force the diaper to stick to the baby's skin, thereby creating heat buildup and increasing the occurrence of rashes on the baby's skin.

SUMMARY OF THE PRESENT INVENTION

The present invention is a novel diaper cover which contains a multiplicity of different layers of specific material to provide two essential functions. The first essential function of the present invention diaper cover is to be permeable to air. The second essential function of the present invention diaper cover is to be essentially nonpermeable to water and other liquids. Therefore, the present invention serves as a very efficient diaper cover to seal in urine and other exrement in the area between the diaper and the inner portion of the diaper cover while at the same time permitting air currents to pass into and out of the diaper cover to thereby assist in removing the unpleasant smell associated with the urine and excrement.

The present invention diaper cover also includes a multiplicity of tabs located at the corner areas of the diaper cover on the interior face. This permits the diaper to be inserted into the tabs and enclosed around the baby when the diaper cover is closed. Through these novel tabs, diaper closing means such as sharp pins are eliminated, thereby substantially increasing the efficiency with which the diaper and diaper cover are placed around the baby and substantially reducing the risk of injury to the baby due to the elimination of sharp closing means.

It has been discovered, according to the present invention, that if a diaper cover is made of three separate layers, namely a mesh-like inner portion made of material such as nylon, an absorbant central portion made of material such as polyvinyl chloride or polyethylene, and an outer layer of very fine mesh-like material such as nylon, then the present invention improved diaper cover is permeable to air but nonpermeable to liquids such as water or urine. As a result, urine and other excrement is retained between the diaper and the diaper cover and will not seep out while the air permeability feature permits the unpleasant smell associated with urine and excrement to be dissipated and further reduces the heat buildup around the baby.

It has additionally been discovered, according to the present invention, that if a diaper cover is fastened around the diaper through use of velcro or other non-sharp closing means, there is a substantially reduced likelihood of the baby being accidentally injured. The fabric combination as set forth above accomodates this novel type of closure mechanism.

It has further been discovered, according to the present invention, that if the diaper cover includes a tab adjacent each of its corners on the interior surface of the diaper cover, then the diaper can be inserted through these tabs and enclosed around the baby at the same time the diaper cover is enclosed around the baby, thereby eliminating the need for separate diaper closing means.

It is therefore an object of the present invention to provide a diaper cover to be worn around the diaper and which will provide effective sealing means to prevent urine and excrement seepage by being nonpermeable to liquids while at the same time permitting the unpleasant smell to be dissipated by being permeable to air.

It is another object of the present invention to provide a diaper cover which is made of material that is soft and will not injure the baby, is made of material that can be readily washable, and is made of material that can be used with safe non-sharp closing means such as velcro mating members.

It is a further object of the present invention to provide a diaper cover which contains associated means to close the diaper simultaneously with the closure of the diaper cover, thereby eliminating the need for independent diaper closing means.

Further novel features and other objects of the present invention will become apparent from the following detailed description, discussion and the appended claims, taken in conjunction with the drawings.

DRAWING SUMMARY

FIG. 1 is a perspective view of the present invention diaper as viewed from the inside portion which fits against the diaper.

FIG. 2 is a cross-sectional view taken along line 1—1 of FIG. 1.

FIG. 3 is a plan view of the present invention diaper cover as viewed from the inside portion when in the fully opened position.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spriit, scope and contemplation of the invention as further defined in the appended claims.

Referring particularly to the drawings and more particularly to FIG. 1, there is shown at 10 a diaper cover which incorporates the present invention. The diaper cover shown at 10 incorporates the use of a base flap member 12 which contains a female velcro like surface 14 (such as brushed nylon or a continuous loop surface) and a pair of overlay flap members 16 and 20, respectively, which contain male velcro surfaces 18 and 22 respectively. When inserted over the diaper, the male velcro surfaces 18 and 22 are closed onto the female velcro like surface 14 to thereby seal the diaper cover 10 around the diaper. It is emphasized that this is only one diaper cover embodiment with which the present invention can be utilized and the present invention can be incorporated into any multiplicity of diaper cover designs.

The details of the present invention are shown in greater detail in the cross-sectional view of FIG. 2. As shown in the perspective view of FIG. 1 and the cross-sectional view of FIG. 2, the first element of the present invention diaper cover consists of a mesh-like fabric 30 located on the innermost portion of the diaper cover. The mesh-like fabric 30 includes a grid of porous fabric 32 and a multiplicity of openings 36. The porous fabric 32 in turn contains a multiplicity of fine openings 34. The mesh-like fabric can be made of any number of different materials such as nylon or cotton, or of synthetic fibers. A major function of the mesh-like inner fabric layer is to provide a soft surface which will not stick to the baby's skin or to the diaper. This further permits air to circulate adjacent the baby's legs to assist in the removal of heat buildup and reduction of rashes.

The second element of the present invention diaper cover consists of a layer of foam-like material located beneath or behind the mesh-like layer 30. The layer of foam-like material 40 must be nonpermeable to liquid such as urine or water and at the same time can be slightly permeable to air. By way of example, the foam material 40 can be polyvinyl chloride which can be approximately 0.043 inches thick and is packed with a density of approximately 7.52 pounds per cubic foot. In experiments which were performed on this desired type of material, in which the testing atmosphere was maintained at approximately 73.4°–1.8° F. and 50–2% relative humidity, the air permeability was approximately 1.05 cubic feet per minute per square foot of area or greater while the rate of absorbtion of liquid was approximately 0.22 grams over approximately 30 minutes. The tests showed that the polyvinyl chloride material with the above described properties was essentially not water permeable and only slightly air permeable. The air permeability was not sufficient to permit the baby to be cold but was sufficient to permit air to circulate in and out of the diaper cover to thereby reduce the smell of urine or other exrement and further to reduce heat buildup around the baby's skin. In addition to polyvinyl chloride, other similar materials such as polyethylene can be used. A thickness of approximately 0.043 inches and a foam packing density of approximately 3.00 pounds per cubic foot leads to an ideal combination of minimum thickness yet effective nonpermeability to liquid but soft and elastic. It is emphasized that the present invention is not limited to polyvinyl chloride or polyethylene foam of the above set forth thickness and density and other thicknesses and packing densities which produce the effect of being essentially nonpermeable to liquid but permeable to air are within the spirit and scope of the present invention. A range of foam thicknesses between approximately 0.043 inches and approximately 0.070 inches is satisfactory for use in the present invention. It is emphasized that the foam layer need be only slightly permeable to function properly.

The final and outermost layer 50 is composed of porous mesh-like material which conatins a multiplicity of very fine openings 52. The fine openings 52 provide a narrow passageway for air currents while at the same time providing secondary cover for the foam layer. One material of which the outermost layer 50 can be made is nylon. Synthetic fibers and fine porous cotton are other materials which can be used with the present invention.

Defined more broadly, the present invention is a diaper cover comprising an innermost layer of mesh-like fabric material 30 which includes a grid of porous fabric 32 containing a multiplicity of fine openings 34 and a grid patters of larger openings 36 interspersed throughout the porous fabric. The diaper cover further comprises a second layer of foam-like material 40 located behind the layer of mesh-like fabric material 30, and possessing properties which permit it to be essentially nonpermeable to liquid but permeable to air. The diaper cover further comprises a third or outermost layer of porous mesh-like material 50 located behind the layer of foam-like material 40, which contains a multiplicity of very fine openings 52.

While the second layer of foam-like material has been described as being made of polyethylene or polyvinyl chloride which is approximately 0.043 inches thick, it will be appreciated that this thickness can be at least 0.043 inches thick or greater for purposes of utilization with the present invention. Also, while the foam packing density of the polyvinyl chloride has been described as being approximately 7.52 pounds per cubic foot, and the foam packing density of the polyethylene has been described as being approximately 3.00 pounds per cubic foot, it will be appreciatead that this foam packing density can be equal to or greater than 7.52 pounds per cubic foot or 3.00 pounds per cubic foot, respectively, for purposes of utilization with the present invention.

Defined even more broadly, the present invention is a diaper cover comprising a multiplicity of layers of different material which provides the diaper cover with the properties of being nonpermeable to liquid but permeable to air.

The cell structure of the polyvinyl chloride or polyethylene used with the present invention diaper cover must be closed celled.

Another novel feature of the present invention is the inclusion of a multiplicity of tabs or straps on the inner surface of the present invention diaper cover. This is best illustrated in the plan view of FIG. 3. Located adjacent to each corner of the diaper cover 10 is a tab or strap, numbers 60, 62, 64 and 66 respectively. Each tab or strap accomodates one corner of the diaper (not shown). Therefore, the diaper can be inserted directly into the diaper cover 10 by inserting one of the four corners of the diaper into a respective tab or strap 60, 62, 64 and 66. Then, the entire assembly is placed around the baby in the conventional manner and the diaper cover 10 is closed by pressing the male velcro surfaces 18 and 22 against the female velcro surface 14, as previously described. Therefore, when the diaper cover is closed, the diaper is simultaneously closed. Therefore, the need for separate diaper closing means is eliminated. This is especially important since sharp closing means such as pins are eliminated, to thereby provide further protection for the infant.

Defined more broadly, the diaper cover further comprises a multiplicity of straps located on the innermost layer of mesh-like fabric material and located adjacent the extremities of the diaper cover so that a strap can accomodate a respective one of the corners of the diaper which is inserted into and held by the strap.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms of modification in which the invention might be embodied or operated.

The invention has been described in considerable detail in order to comply with the patent laws by providing a full public disclosure of at least one of its form. However, such detailed description is not intended in any way to limit the broad features or principals of the invention, or the scope of patent monopoly to be granted.

What is claimed is:

1. A diaper cover comprising:

a. an innermost layer of mesh-like fabric material which includes a grid of porous fabric containing a multiplicity of fine openings and a grid pattern of larger openings interspersed throughout the porous fabric;

b. a second layer of foam-like material located behind said layer of mesh-like fabric material, and possessing properties which permit it to be essentially nonpermeable to liquid but permeable to air; and c. a third or outermost layer of porous mesh-like material located behind said layer of foam-line material, which contains a multiplicity of very fine openings.

2. The invention as defined in claim 1 wherein said second layer of foam-like material is polyvinyl chloride.

3. The invention as defined in claim 1 wherein said second layer of foam-like material is polyethylene.

4. The invention as defined in claim 1 wherein said innermost layer of mesh-like fabric material is made of nylon.

5. The invention as defined in claim 1 wherein said outermost layer of porous mesh-like material is made of nylon.

6. The invention as defined in claim 1 wherein said second layer of foam-like material is made of polyvinyl chloride which is approximately 0.043 inches thick and consists of a foam packing density of approximately 7.52 pounds per cubic foot.

7. The invention as defined in claim 1 wherein said second layer of foam-like material is made of polyethylene which is approximately 0.043 inches thick and consists of a foam packing density of approximately 3.00 pounds per cubic foot.

8. The invention as defined in claim 1 wherein said second layer of foam-like material is made of polyvinyl chloride which is between a range of thicknesses from approximately 0.043 inches to approximately 0.070 inches and consists of a foam packing density equal to or greater than 7.52 pounds per cubic foot.

9. The invention as defined in claim 1 wherein said second layer of foam-like material is made of polyethylene which is between a range of thicknesses from approximately 0.043 inches to approximately 0.700 inches and consists of a foam packaging density equal to or greater than 3.00 pounds per cubic foot.

10. The invention as defined in claim 2 wherein said polyvinyl chloride has a closed celled structure.

11. The invention as defined in claim 3 wherein said polyethylene has a closed cell structure.

12. The invention as defined in claim 8 wherein said polyvinyl chloride has a closed cell structure.

13. The invention as defined in claim 9 wherein said polyethylene has a closed cell structure.

14. The invention as defined in claim 1 wherein said diaper cover further comprises a multiplicity of straps located on said innermost layer of mesh-like fabric material and adjacent to the extremities of the diaper cover so that a respective strap can accomodate a respective one of the corners of the diaper which is inserted into and held by the strap.

15. The invention as defined in claim 1 further comprising:

a. a pair of male Velcro closing members located on said innermost layer of mesh like fabric and wherein a respective one of the pair of male Velcro members is located adjacent to an edge of the diaper cover, and b. a female Velcro like member located on said third outmost layer of porous mesh like material and at the opposite edge of the diaper cover;

c. whereby the diaper cover may be closed by closing the male Velcro members onto the female Velcro like member.

16. The invention as defined in claim 15 wherein said female Velcro like member is a continuous loop surface.

17. The invention as defined in claim 15 wherein the female Velcro like member is a brushed nylon surface.

* * * * *